US005718102A

United States Patent [19]

Draghetti

[11] Patent Number: 5,718,102

[45] Date of Patent: Feb. 17, 1998

[54] METHOD AND DEVICE FOR FORMING AND TRANSFERRING GROUPS OF CIGARETTES ON A PACKING MACHINE WITH MULTIPLE WRAPPING LINES

[75] Inventor: Fiorenzo Draghetti, Via San Donino, Italy

[73] Assignee: G.D Societa' Per Azioni, Bologna, Italy

[21] Appl. No.: 717,816

[22] Filed: Sep. 24, 1996

[30] Foreign Application Priority Data

Sep. 25, 1995 [IT] Italy ..... BO95A0448

[51] Int. Cl.[6] ..... B65P 19/04

[52] U.S. Cl. ..... 53/444; 53/148; 53/150; 53/151; 53/202; 131/283; 198/418.3

[58] Field of Search ..... 198/418.3; 131/282, 131/283; 53/148, 149, 150, 151, 202, 444

[56] References Cited

U.S. PATENT DOCUMENTS

| | | | |
|---|---|---|---|
| 3,106,282 | 10/1963 | Schmermund | 53/148 X |
| 3,448,846 | 6/1969 | Bardenhagen | 198/418.3 |
| 4,079,575 | 3/1978 | Focke et al. | 53/148 X |
| 4,135,617 | 1/1979 | Davies et al. | 198/458 |
| 4,330,976 | 5/1982 | Blackall et al. | 53/151 |
| 4,531,627 | 7/1985 | Mattei et al. | 198/418.3 |
| 4,571,918 | 2/1986 | Zeitel | 53/149 |
| 4,718,216 | 1/1988 | Focke et al. | 53/148 X |
| 4,735,032 | 4/1988 | Focke | 53/149 |
| 4,819,407 | 4/1989 | Focke et al. | 53/202 |
| 5,038,546 | 8/1991 | Oberdorf | 53/202 |

FOREIGN PATENT DOCUMENTS

| | | |
|---|---|---|
| 0 142 803 A1 | 5/1985 | European Pat. Off. . |
| 2 532 618 A1 | 3/1984 | France . |
| 24 54 289 A1 | 5/1975 | Germany . |

*Primary Examiner*—Daniel Moon

*Attorney, Agent, or Firm*—Marshall, O'Toole, Gerstein, Murray & Borun

[57] ABSTRACT

A method and device for forming and transferring groups of cigarettes on a packing machine with multiple wrapping lines, whereby each group is fed into a respective pocket of a conveyor, and presents a number of superimposed layers fed successively into the respective pocket by push elements for successively expelling the layers from the bottom of respective outlets of a feedbox; the outlets are equal in number to the number of layers forming each group multiplied by a whole number greater than one, and the conveyor is moved intermittently in steps of a length equal to the spacing between two consecutive pockets multiplied by the whole number; at each stop of the conveyor, respective layers are expelled from the outlets of the feedbox and fed into respective pockets; and respective groups are expelled from a number of pockets equal to the whole number, and are fed to an operating unit of the packing machine.

8 Claims, 3 Drawing Sheets

METHOD AND DEVICE FOR FORMING AND TRANSFERRING GROUPS OF CIGARETTES ON A PACKING MACHINE WITH MULTIPLE WRAPPING LINES

BACKGROUND OF THE INVENTION

The present invention relates to a method of forming and transferring groups of cigarettes on a packing machine with multiple wrapping lines.

In the following description, the term "group of cigarettes" is intended to means the cigarettes forming the content of a packet and arranged as inside the finished packet. Moreover, though reference is made herein to a packing machine with two wrapping lines, the method and device according to the present invention may nevertheless be applied to packing machines with more than two wrapping lines.

A group of cigarettes normally comprises twenty cigarettes arranged in three superimposed layers of six or seven cigarettes each, and it is to this type of group that reference will be made in the following description.

Known packing machines with two wrapping lines normally comprise an input feedbox to which the cigarettes are fed in bulk crosswise to their axes, and which comprises two outlets divided internally by partitions into a number of side by side channels equal in number to the cigarettes in one of the layers; and, in the course of each operating cycle of the packing machine, appropriate operating members provide for forming, at each outlet of the feedbox, a group comprising a given number of superimposed layers of cigarettes.

In the course of each operating cycle of the packing machine, the two groups so formed are fed by a pusher, in a direction parallel to the axes of the cigarettes, into respective pockets of a conveyor traveling in steps crosswise to the axes of the cigarettes.

Though the output of cigarette packing machines with two wrapping lines is normally greater than that of single-line machines, it is nevertheless limited to some extent by the characteristics of the devices for forming the groups of cigarettes for packing. That is, with such devices, the formation of each pair of groups at the bottom of the feedbox takes a relatively long time, on account of the fairly slow speed at which the cigarettes drop by force of gravity along the channels of the feedbox.

SUMMARY OF THE INVENTION

It is an object of the present invention to provide a method and device enabling groups of cigarettes to be formed and transferred rapidly on a packing machine with multiple wrapping lines.

According to the present invention, there is provided a method of forming and transferring groups of cigarettes on a packing machine with multiple wrapping lines, characterized in that each said group is fed into a respective pocket of a conveyor, and comprises a number of superimposed layers fed successively into the respective said pocket by push means for successively expelling the layers from the bottom of respective outlets of a feedbox; said outlets being equal in number to the number of layers forming each said group multiplied by a whole number greater than one; said conveyor being moved intermittently in steps of a length equal to the spacing between two consecutive said pockets multiplied by said whole number; respective layers being expelled simultaneously from the outlets of said feedbox and fed into respective said pockets at each stop of said conveyor; and, at each stop of said conveyor, respective groups being expelled from a number of pockets equal to said whole number, and supplied to an operating unit of said packing machine.

The present invention also relates to a device for forming and transferring groups of cigarettes on a packing machine with multiple wrapping lines.

According to the present invention, there is provided a device for forming and transferring groups of cigarettes on a packing machine with multiple wrapping lines, characterized in that each said group is fed into a respective pocket of a conveyor, and comprises a number of superimposed layers fed successively into the respective said pocket by push means for successively expelling the layers from the bottom of respective outlets of a feedbox; said outlets being equal in number to the number of layers forming each said group multiplied by a whole number greater than one; the device also being characterized by comprising drive means for moving said conveyor intermittently in steps of a length equal to the spacing between two consecutive said pockets multiplied by said whole number; said push means, at each stop of said conveyor, simultaneously expelling respective layers from the outlets of said feedbox, and feeding said layers into respective said pockets; and further push means being provided for expelling respective groups, at each stop of said conveyor, from a number of pockets equal to said whole number, and supplying said groups to an operating unit of said packing machine.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
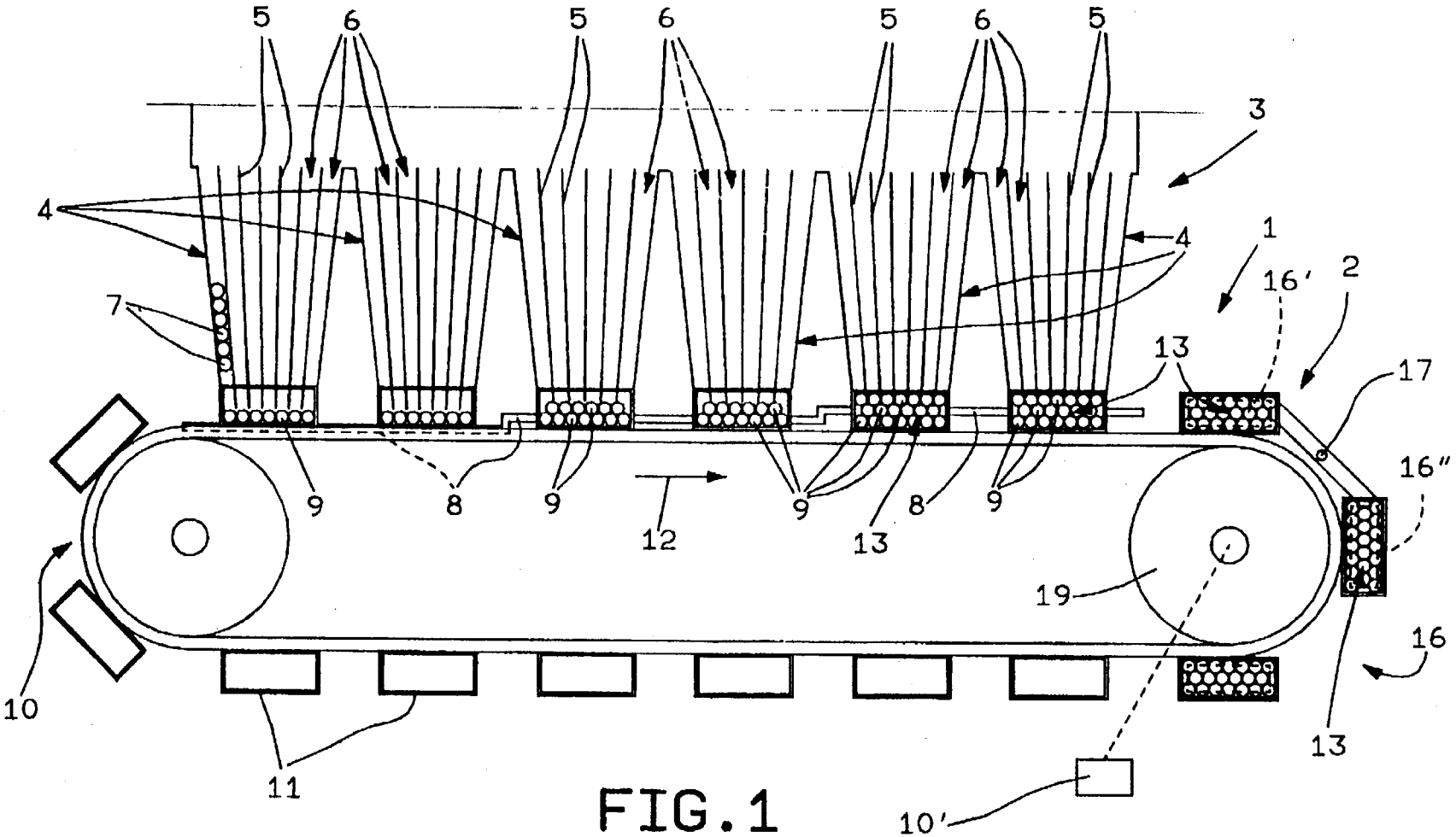
FIG. 1 shows a schematic view of a portion of a cigarette packing machine comprising a device for forming groups of cigarettes and implementing the method according to the present invention.
Figure 2:
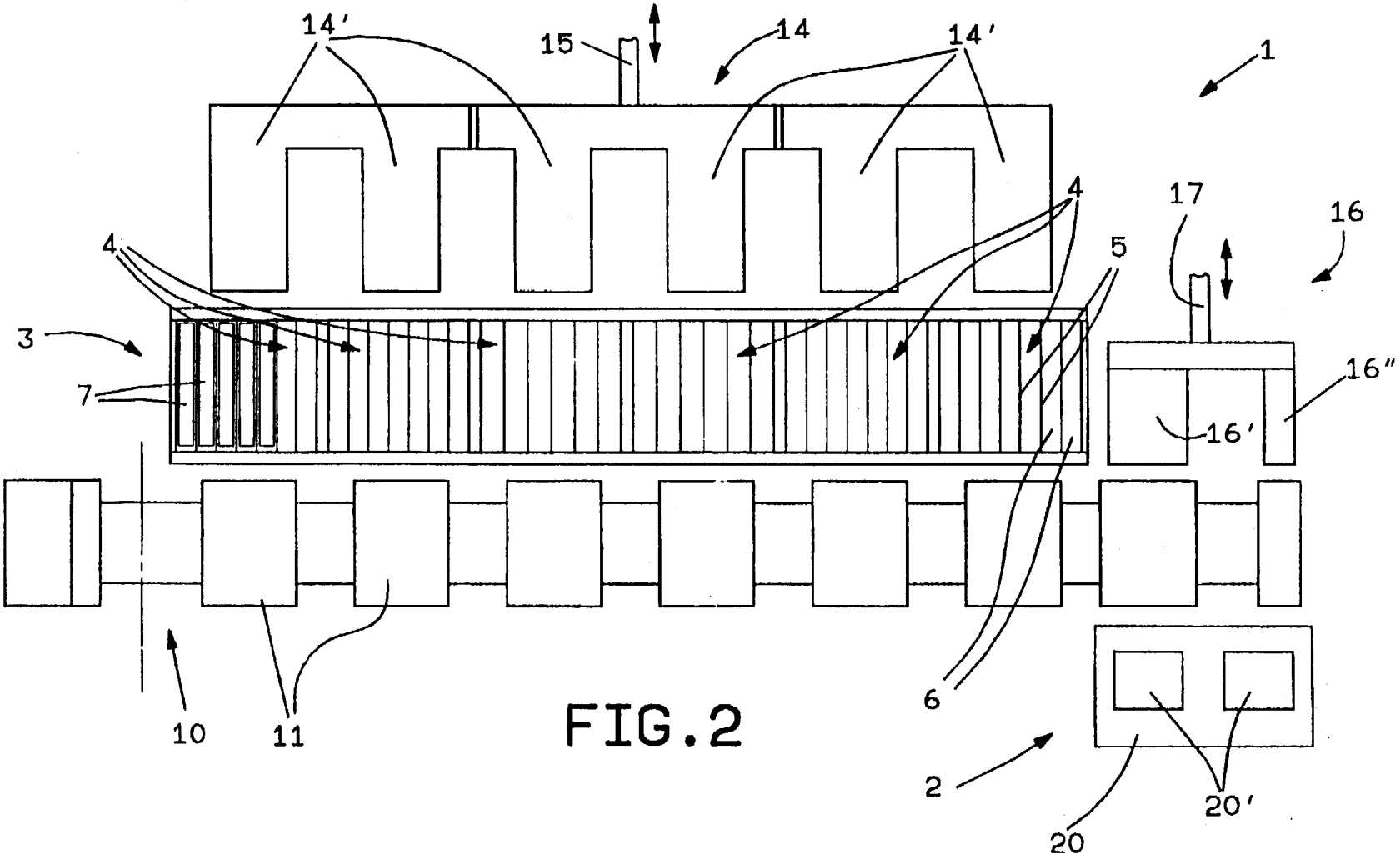
FIG. 2 shows a plan view of a number of details in FIG. 1.

FIGS. 1 and 2 show a device for forming groups of cigarettes, and which constitutes the input portion 1 of a cigarette packing machine 2 with two wrapping lines 20'.

Input portion 1 comprises an input feedbox 3, the bottom output end portion of which comprises six downward-tapering outlets 4, each divided internally by partitions or walls 5 into a number of channels 6. In the embodiment of feedbox 3 in FIGS. 1 and 2, channels 6 are seven in number for the two outlets 4 on the left and the two outlets 4 on the right, and are six in number for the two central outlets 4.

As shown particularly in FIG. 1, cigarettes 7 arranged in a column are fed by force of gravity and in a direction crosswise to their axes down each channel 6, and the bottom cigarette 7 in each column is deposited onto a plate 8 located beneath respective outlet 4 and at a distance from outlet 4 just slightly greater than the diameter of cigarettes 7.

On plates 8, which are located beneath respective pairs of adjacent outlets 4 and at different levels increasing from left to right in FIG. 1 by a height substantially equal to the diameter of a cigarette 7, there are formed, in the course of each operating cycle of device 1, respective side by side pairs of layers 9 of cigarettes (FIG. 1) at a level just below the bottom end of respective outlets 4.

To the side of plates 8 (FIG. 2), there extends the top branch of a conveyor belt 10, which is driven in steps by a known drive element shown schematically by block 10', and is fitted with equally spaced pockets 11. Each pocket 11 extends crosswise to the traveling direction, indicated by arrow 12 in FIG. 1, of the top branch of conveyor 10, and is positioned with its input end facing plates 8.

At each step of conveyor belt 10, each pocket 11 is fed forward by a distance equal to twice the spacing between two consecutive pockets 11, so as to come to a stop in front of each plate 8 and successively receive three layers 9, which, as pockets 11 travel past feedbox 3, are superimposed one on top of the other inside pocket 11 to form a group 13 of cigarettes 7 constituting the content of a packet (not shown).

At each stop of conveyor belt 10, each layer 9 is fed into respective pocket 11 by a pusher 14, which is connected integral with a cross member 15 moved back and forth by actuating means (not shown) in a horizontal direction perpendicular to direction 12, and is located, in a withdrawn idle position, on the opposite side of feedbox 3 to conveyor belt 10. Pusher 14 is movable between said withdrawn position and a forward position in which six push plates 14' of pusher 14 engage the space between the bottom ends of respective outlets 4 and respective underlying plates 8. In known manner (not shown), pusher 14 in the forward position is located with the free ends of push plates 14' contacting respective ends of layers 9 of cigarettes just fed into respective pockets 11.

A pusher 16, connected integral with a cross member 17 moved back and forth by actuating means (not shown) in a horizontal direction perpendicular to direction 12, is located, in a withdrawn idle position, on the opposite side of feedbox 3 to conveyor belt 10. Pusher 16 is movable between said withdrawn position and a forward position in which, at each stop of conveyor belt 10, two push plates 16' and 16" of pusher 16 axially engage the space inside two consecutive pockets 11 containing respective groups 13 of cigarettes and located at a portion of conveyor belt 10 downstream from feedbox 3 in direction 12. Preferably, said portion of conveyor belt 10 is curved, by comprising a portion of conveyor belt 10 looped about a transmission pulley 19.

In actual use, when six successive pockets 11 of conveyor belt 10 are arrested in front of respective outlets 4, pusher 14 is operated by cross member 15 so that push plates 14' engage the space between respective outlets 4 and underlying plates 8, and push respective layers 9 into respective pockets 11.

At the end of each operating cycle of pusher 14, the two pockets 11 at outlets 4 to the right in the drawings contain respective groups 13, which, in the course of successive steps of conveyor belt 10, are brought into the operating region of pusher 16.

At each stop of conveyor belt 10, pusher 16 is operated to expel respective groups 13 of cigarettes 7, by means of respective push plates 16' and 16", from the two pockets 11 facing it, and to feed said groups to an operating unit of packing machine 2, comprising, for example, a conveying or wrapping device shown schematically by block 20 and comprising said two wrapping lines 20'.

Device 1 for forming and transferring groups 13 of cigarettes 7 therefore provides for fully achieving the object of the present invention, i.e. for enabling highly rapid operation, by individually forming and transferring, at each operating cycle of packing machine 2, the layers 9 eventually forming part of two groups 13, and by simultaneously transferring two groups 13 to unit 20.

Device 1 for forming and transferring groups 13 of cigarettes 7 may be applied to packing machines featuring more than two wrapping lines by simply arranging matters so that outlets 4 of feedbox 3 are equal in number to the number of layers 9 in each group 13 multiplied by a whole number greater than one; that conveyor belt 10 is operated intermittently in steps of a length equal to the spacing between two consecutive pockets 11 multiplied by said whole number; that, at each stop of conveyor belt 10, respective layers 9 are expelled simultaneously from outlets 4 of feedbox 3 and fed into respective pockets 11; and that, at each stop of conveyor belt 10, respective groups 13 are expelled from a number of pockets 11 equal to said whole number, and supplied to said operating unit 20 of packing machine 2.

Conveyor belt 10 may also be powered to operate in steps of a length equal to the spacing between two consecutive pockets 11, in which case, pushers 14 and 16 are operated at alternate stops of conveyor belt 10.

Figure 3:
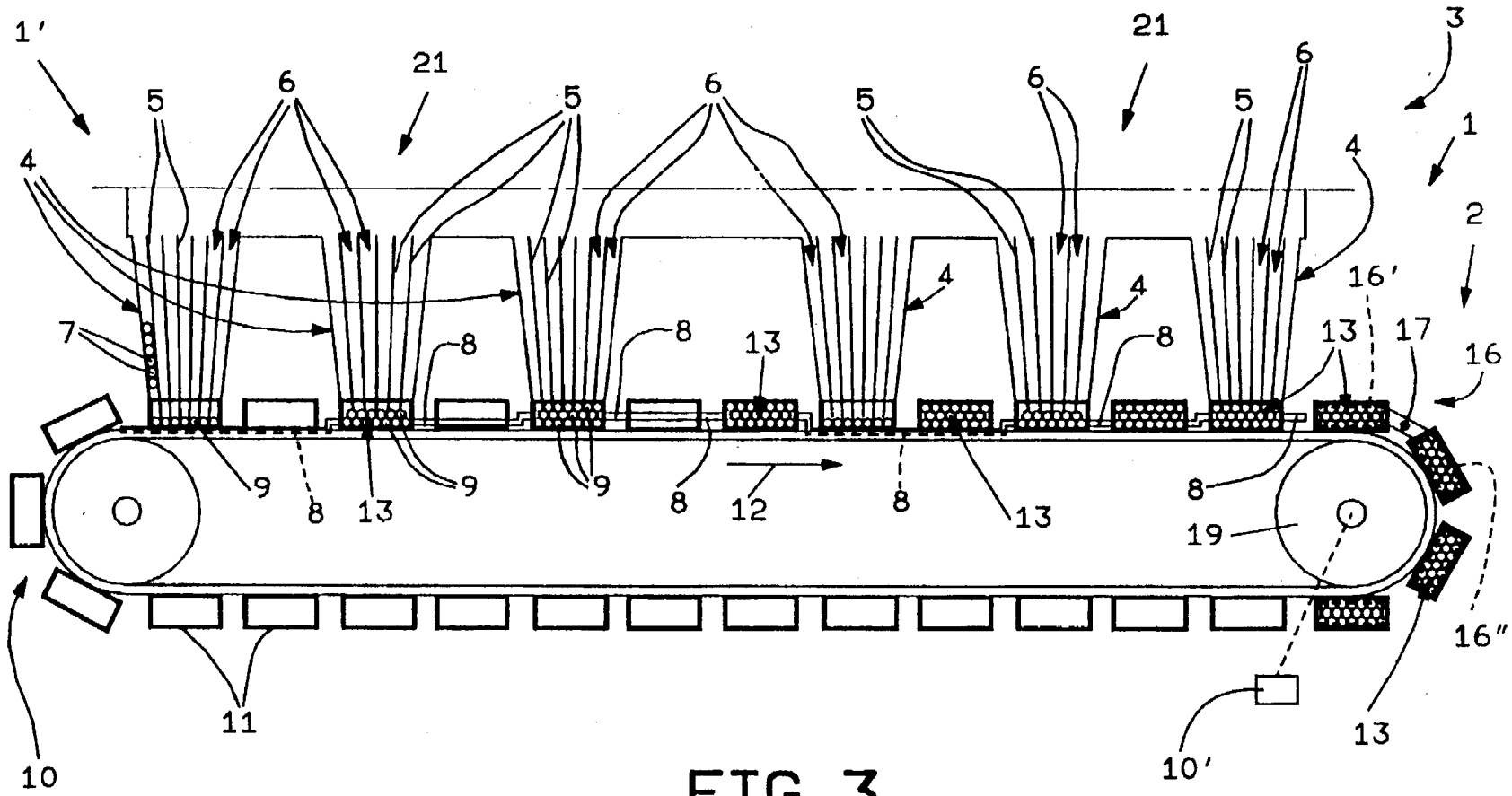
FIG. 3 shows a schematic view of a variation of the device in FIGS. 1 and 2.

FIG. 3 shows a device 1' by way of a variation of device 1, and the component parts of which are indicated, wherever possible, using the same numbering system as for the corresponding parts described in connection with FIGS. 1 and 2.

In device 1', conveyor belt 10 is fitted with a number of equally spaced pockets 11, preferably with as small a spacing as possible; the six outlets 4 of feedbox 3 are divided into two identical groups 21, each comprising three side by side outlets 4 parallel to direction 12; when conveyor belt 10 is arrested, and in the same way as described with reference to FIGS. 1 and 2, the bottom output ends of outlets 4 of each group 21 are positioned facing respective nonconsecutive pockets 11 alternating in pairs with a further pocket 11; and, again when conveyor belt 10 is arrested, the two sets of five pockets 11 facing respective groups 21 of outlets 4 are separated by a pair of consecutive pockets 11.

As described with reference to device 1, the bottom cigarette 7 in the column in each channel 6 is deposited onto a plate 8 located beneath respective outlet 4 and at a distance from outlet 4 slightly greater than the diameter of cigarettes 7.

On plates 8, which, within each group 21 of outlets 4, are located at different levels increasing from left to right in FIG. 3 by a height substantially equal to the diameter of cigarette 7, respective layers 9 of cigarettes are formed, as already described, in the course of each operating cycle of device 1'.

Push plates 14' of pusher 14 of device 1' are so located (not shown) as to engage, as already described, the space between the bottom ends of respective outlets 4 and respective underlying plates 8.

In actual use, at each step of conveyor belt 10, each pocket 11 is fed forward by a distance equal to twice the spacing between two consecutive pockets 11; and, whenever six pockets 11 of conveyor belt 10 are arrested in front of respective outlets 4, pusher 14 is operated by cross member 15 so that push plates 14' engage the space between respective outlets 4 and underlying plates 8, and push respective layers 9 into respective pockets 11 as described previously.

At the end of each operating cycle of pusher 14, and as a consequence of the arrangement of the two groups 21 of outlets 4 and plates 8, the three pockets 11 at outlets 4 in each group 21 respectively contain, from left to right in FIG. 3, one, two and three layers 9 of cigarettes 7; and the three pockets 11 immediately downstream, in the traveling direction of conveyor belt 10, from those just fed with a layer 9 of cigarettes 7 from the outlets 4 forming part of group 21 to the left in FIG. 3 are empty, and are successively fed past the outlets 4 forming part of group 21 to the right, so as to also receive respective layers 9 of cigarettes 7. In exactly the same way as described with reference to FIGS. 1 and 2, therefore, respective groups 13 are formed inside two pockets 11 at each operating cycle of device 1'; and, in the course of successive steps of conveyor belt 10, the pockets 11 containing respective groups 13 are brought in pairs within the operating region of pusher 16, which, at each operating cycle of device 1', feeds two groups 13 to said operating unit 20 as already described.

The above design of device 1' provides for closely spacing the pockets 11 of conveyor belt 10, which may therefore be operated in very small steps to minimize the acceleration and inertia to which it is subjected.

I claim:

1. A method of forming and transferring groups of cigarettes on a packing machine with multiple wrapping lines, the method comprising transferring, via push means, single layers of cigarettes from respective outlets of a feedbox, containing a mass of cigarettes, into pockets of an intermittent conveyor; forming said groups by superimposing said layers as said conveyor moves forward; and transferring said groups, via further push means, from said pockets to said wrapping lines; at least two groups of cigarettes being formed, and as many groups being transferred to said wrapping lines; at each step of said intermittent conveyor.

2. A method as claimed in claim 1, wherein the outlets relative to each layer are equal in number to said wrapping lines.

3. A method as claimed in claim 1, wherein the outlets of said feedbox are spaced as said pockets of said intermittent conveyor.

4. A method as claimed in claim 1, wherein said outlets are equal in number to the layers forming each said group multiplied by a whole number greater than one, and are divided into a number of sets equal to said whole number; the outlets in each said set being distributed with a pitch which is equal to a distribution pitch of said pockets multiplied by said whole number; and, when said intermittent conveyor is stopped, each pair of said sets being separated by a number of pockets equal to said whole number.

5. A device for forming and transferring groups of cigarettes on a packing machine with multiple wrapping lines, comprising push means for transferring single layers of cigarettes from a feedbox, containing a mass of cigarettes, into pockets of an intermittent conveyor, said groups being formed by superimposing said layers as said conveyor moves forward; and further push means for transferring said groups from said pockets to said wrapping lines; at least two groups of cigarettes being formed, and as many groups being transferred to said wrapping line at each step of said intermittent conveyor.

6. A device as claimed in claim 5, characterized in that the number of outlets relative to each layer equals the number of said wrapping lines.

7. A device as claimed in claim 5, wherein the outlets of said feedbox are spaced as said pockets of said intermittent conveyor.

8. A device as claimed in claim 5 wherein said outlets are equal in number to the layer forming each said group multiplied by a whole number greater than one, and are divided into a number of sets equal to said whole number; the outlets in each said set being distributed with a pitch which is equal to a distribution pitch of said pockets multiplied by said whole number; and when said intermittent conveyor is stopped, each pair of said sets being separated by a number of pockets equal to said whole number.

* * * * *